US006279254B1

(12) United States Patent
Gill et al.

(10) Patent No.: US 6,279,254 B1
(45) Date of Patent: Aug. 28, 2001

(54) FAN ADVERTISING DEVICE

(75) Inventors: James G. Gill, Glendale; Dylan Hixon, Hollywood; James Lux, Westlake Village; Martin J. Becker, Glendale, all of CA (US)

(73) Assignees: James C. Gill; Becker Family Trust, both of Glendale, CA (US)

( * ) Notice: Subject to any disclaimer, the term of this patent is extended or adjusted under 35 U.S.C. 154(b) by 0 days.

(21) Appl. No.: 09/178,666

(22) Filed: Oct. 26, 1998

(51) Int. Cl.[7] ..... G09F 19/00

(52) U.S. Cl. ..... 40/439; 40/412; 40/422; 40/477

(58) Field of Search ..... 40/439, 441, 422, 40/412, 477, 539, 218, 601; 446/178, 226, 201, 197, 198

(56) References Cited

U.S. PATENT DOCUMENTS 2,348,250 * 5/1944 Gardner et al. .
2,911,745 * 11/1959 Simon .
3,159,935 * 12/1964 Rubens .
3,346,978 * 10/1967 Letsinger .
3,686,494 * 8/1972 Naylor .
3,744,220 7/1973 Klein .
3,798,816 * 3/1974 Flaherty .
3,803,398 * 4/1974 Walker .
4,196,976 * 4/1980 Hoffman, III .
4,330,953 * 5/1982 Damiano .
4,765,079 * 8/1988 Takahashi .
4,886,233 * 12/1989 Bateman et al. .
4,920,674 * 5/1990 Shaeffer .
5,096,467 3/1992 Matsui .
5,125,177 * 6/1992 Colting .
5,186,675 2/1993 Stoddard .
5,220,740 * 6/1993 Brault .
5,293,707 3/1994 Shaeffer .
5,295,811 * 3/1994 Chiu .
5,314,368 * 5/1994 Cheng .
5,395,087 * 3/1995 VanBatsen .
5,416,994 * 5/1995 McLaughlin .
5,794,364 * 8/1998 Richmond .

* cited by examiner

*Primary Examiner*—B. Dayoan
*Assistant Examiner*—William L. Miller
(74) *Attorney, Agent, or Firm*—James Creighton Wray; Meera P. Narasimhan; James C. Gill and Becker Family Trust

(57) ABSTRACT

A fan advertising device has a portable barrel with a fan, a pivotable or tiltable stand and a modified exterior fan housing. Metal fittings on the inside of the barrel, near the output end of the fan, allow for connection of metal inserts for accessories. The sock is held in place by a shock cord that fits into a groove on the exterior of the fan housing near the output end. A circular opening is located below the groove but above the fan to allow various objects, such as ping pong balls, to be placed into the airstream inside the sock. Those objects act as noise makers, attracting attention to and adding to the visual effectiveness of the sock. A light may be attached to the grate on the inside of the fan allowing for illumination of the entire sock. Illuminating the sock is useful for increasing visibility during darker hours.

32 Claims, 1 Drawing Sheet

FAN ADVERTISING DEVICE

BACKGROUND OF THE INVENTION

A sock suspended over the outlet end of a portable fan is inflated by a portable fan for use as an advertising device.

In the past, it has been known to provide a sock or balloon in combination with a source of air or like gas to inflate the balloon, such that when the balloon is inflated, the balloon or a message preprinted on the balloon becomes discernible. In prior art devices, air or like gas is forced into balloons from non-portable air sources, like exhaust vent air outlets.

A need exists for a portable device that allows for the quick and efficient creation of three dimensional advertising displays at any desired location.

SUMMARY OF THE INVENTION

To fulfill that need, the invention provides a small, compact fan advertising device with a housing for a portable barrel fan.

A preferred fan advertising device has a portable barrel fan with a stand that permits the fan to be tilted. A preferred device has a groove on the fan housing near the output end. The advertising sock may be held in place by any known means. A shock cord that fits into the groove is one preferred means.

A preferred advertising device has a stand attached on the exterior of the fan housing. The stand tilts, pivots, and/or rotates the fan to allow the sock to be inflated at any angle with respect to the ground.

A preferred advertising device has a light attached to the grate on the inside of the fan housing. The light allows for illumination of portions of or of the entire sock to increase visibility in dark environments.

A preferred advertising device has an opening below the shock cord to allow objects to be placed into the airstream inside the sock. For example, ping pong balls may be introduced inside the sock. Those objects act as noisemakers drawing attention to and adding to the visual effectiveness of the sock.

A preferred fan advertising device has metal fittings on the inside of the barrel, near the output end on the fan. The fittings allow for connection of metal inserts. Accessories, such as hoop supports, may be secured to the fan through the use of the inserts.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
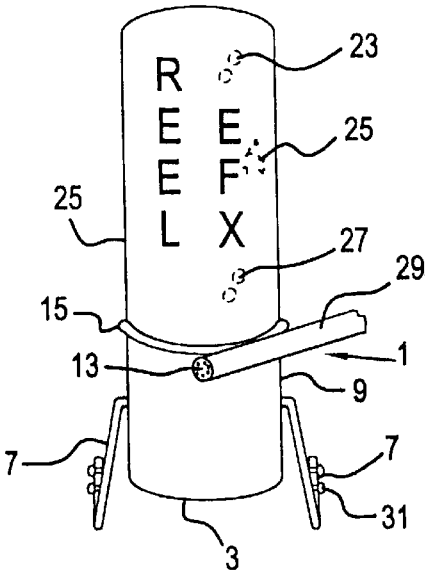
FIG. 1 is a perspective view of the fan advertising device.

FIG. 1 shows the fan advertising device 1. A fan 3, preferably a portable barrel fan, is used to inflate a sock 25 displaying an advertisement. In preferred embodiments, a stand 7 with wheels permits the fan 3 to be tilted, rotated or pivoted, allowing the sock 25 to extend at various angles to the ground.

The sock 25 is held in place by a shock cord 15. The cord 15 is elastic and is stretched to fit over the fan housing 9. The cord rests in a circular groove 11 (FIG. 2A) near the outlet end of the fan 3. An opening 13 in the housing 9 is located between the shock cord 15 and the fan grill 5. A removable supply 29 supplies entertainment objects through the opening. When the fan operates the objects are suctioned from the supply 29 and suspended in the sock 25. Objects may also be inserted into the opening manually.

Opening 13 allows objects, such as ping pong balls 23, to be placed into the air stream inside the sock 25. Those objects act as noise makers drawing attention to the device as well as adding to the visual effectiveness of the sock 25. Other entertainment objects, such as but not limited to, confetti 25, illuminating objects 27 and the like may be supplied through opening 13 and remain suspended in the sock when the fan inflates the sock.

Figure 2A:
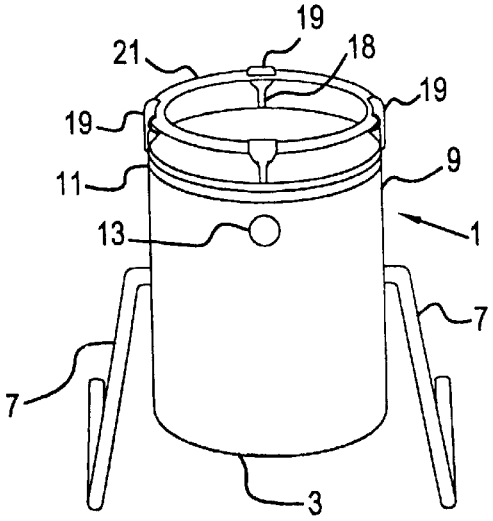
FIG. 2A is a perspective view of the fan advertising device and 2B is a top view of the shock cord.
Figure 2B:
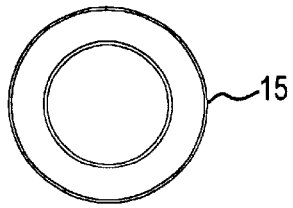

FIG. 2A shows a perspective view of the fan advertising apparatus 1. A portable barrel fan 3 is fitted at pivots 8 to stand 7 to allow tilting or pivoting. The fan's housing 9 has a groove 11 near the outlet end to receive the elastic shock cord 15 that clamps the advertising sock 25 over the fan. A top view of the shock cord is shown in FIG. 2B. Opening 13 below the groove allows objects to be supplied to the air stream inside the sock 25. Metal fittings 18 on the inside of the barrel near the output end of the fan 3 allow for connection of metal inserts 19 for accessories 21. One such accessory is a hoop support 21 for securing the sock 25 prior to inflation.

Figure 3:
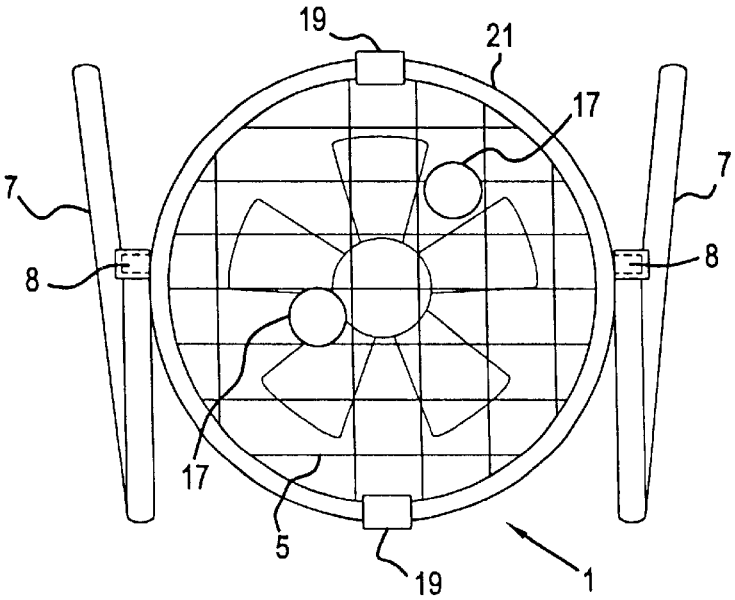
FIG. 3 is a top view of the fan advertising device.

FIG. 3 shows an overhead view of the fan advertising apparatus 1. The portable barrel fan 3 is fitted with a stand 7 to allow tilting. A grate 5 is placed near the outlet end of the fan 3. A light 17 may be attached to the grate in the housing for illumination of the sock 25. Metal inserts 19 allow for connection of accessories.

While the invention has been described with reference to specific embodiments, modifications and variations of the invention may be constructed without departing from the scope of the invention, which is defined in the following claims.

We claim:

1. Fan advertising apparatus comprising a fan, a portable barrel housing for holding the fan, an advertising sign removably connected to the housing and a stand for supporting the barrel housing and the fan spaced from a support surface, further comprising an opening on the barrel housing, further comprising a supply removably connectable to the opening, and objects provided through the supply into the barrel housing, the objects being suspended in a net stream generated by the fan.

2. The apparatus of claim 1, wherein the barrel housing is pivotably supported on the stand.

3. The apparatus of claim 1, wherein the advertising sign is an inflatable sock.

4. The apparatus of claim 1, further comprising a light for illuminating the sign.

5. The apparatus of claim 4, wherein the light is attached to an interior of the barrel housing.

6. The apparatus of claim 1, further comprising a groove on the barrel housing.

7. The apparatus of claim 1, wherein the opening is provided on the barrel housing between the fan and the advertising sign.

8. The apparatus of claim 1, further comprising wheels attached to the stand for moving the barrel housing.

9. The apparatus of claim 1, further comprising a grate positioned within the barrel housing.

10. Fan advertising apparatus comprising a fan, a portable barrel housing for holding the fan, an advertising sign connected to the housing and a stand for supporting the housing and the fan, a groove on the housing and further comprising a shock cord locatable in the groove for securing the advertising sign.

11. Fan advertising apparatus comprising a fan, a portable barrel housing for holding the fan, an advertising sign removably connected to the housing and a stand for supporting the barrel housing and the fan spaced from a support surface, further comprising fittings on the barrel housing, further comprising inserts provided in the fittings.

12. The apparatus of claim 11, wherein the fittings are of metal.

13. The apparatus of claim 11, wherein the inserts are of metal.

14. The apparatus of claim 11, further comprising a hoop support connected to the inserts for securing the advertising sign.

15. The apparatus of claim 11, further comprising accessories connectable to the fittings.

16. Advertising apparatus comprising a barrel fan housing, a barrel fan in the housing, a stand for pivotably holding the housing, and an inflatable advertising sign removably attached to the housing, further comprising an opening on the housing, further comprising objects provided through the opening into the housing.

17. The apparatus of claim 16, further comprising a groove on the housing for attaching the advertising sign.

18. The apparatus of claim 16, further comprising a light attached to the housing for illuminating the advertising sign.

19. The apparatus of claim 16, further comprising wheels attached to the stand.

20. The apparatus of claim 16, further comprising a grate positioned within the housing.

21. Advertising apparatus comprising a barrel fan housing, a barrel fan in the housing, a stand for pivotably holding the housing, and an inflatable advertising sign removably attached to the housing, a groove on the housing for attaching the advertising sign, and further comprising a shock cord positionable in the groove for securing the advertising sign.

22. Advertising apparatus comprising a barrel fan housing, a barrel fan in the housing, a stand for pivotably holding the housing, and an inflatable advertising sign removably attached to the housing, an opening in the housing, objects provided through the opening into the housing, wherein the objects are ping pong balls.

23. Advertising apparatus comprising a barrel fan housing, a barrel fan in the housing, a stand for pivotably holding the housing, and an inflatable advertising sign removably attached to the housing, an opening in the housing, objects provided throuah the opening into the housing, wherein the objects are entertainment devices.

24. Advertising apparatus comprising a barrel fan housing, a barrel fan in the housing, a stand for vivotably holding the housing, and an inflatable advertising sign removably attached to the housing, an opening in the housing, objects provided through the opening into the housing, wherein the objects are confetti.

25. Advertising apparatus comprising a barrel fan housing, a barrel fan in the housing, a stand for pivotably holding the housing, and an inflatable advertising sign removably attached to the housing, further comprising fittings on the housing, further comprising inserts provided in the fittings.

26. The apparatus of claim 25, further comprising a hoop support connected to the inserts for securing the advertising sign.

27. The apparatus of claim 25, further comprising accessories connectable to the fittings.

28. A fan advertising display comprising providing a barrel fan housing with a barrel fan at a desired location, attaching an advertising sign to the housing, supporting the housing on a movable stand spaced from a support surface, and inflating the advertising sign, further comprising supplying objects in the housing through an opening and suspending the objects in an air stream of the fan.

29. The display of claim 28, further comprising illuminating the sign with an illumination device.

30. An advertising display comprising providing a barrel fan housing with a barrel fan at a desired location, attaching an advertising sign to the housing, supporting the housing on a movable stand, and inflating the advertising sign, further comprising securing the advertising sign with a shock cord on a groove on the housing.

31. A fan advertising display comprising providing a barrel fan housing with a barrel fan at a desired location, attaching an advertising sign to the housing, supporting the housing on a movable stand, and inflating the advertising sign, further comprising providing fittings in the housing, further comprising connecting inserts to the fittings.

32. The display of claim 31, further comprising connecting accessories to the inserts.

* * * * *

UNITED STATES PATENT AND TRADEMARK OFFICE

CERTIFICATE OF CORRECTION

PATENT NO. : 6,279,254 B1
DATED : August 28, 2001
INVENTOR(S) : James G. Gill et al.

It is certified that error appears in the above-identified patent and that said Letters Patent is hereby corrected as shown below:

Title page,
Item [73], Assignees, should read:

-- James G. Gill; Becker Family Trust, both of Glendale, CA (US) --

Signed and Sealed this

Twenty-sixth Day of October, 2004

JON W. DUDAS
*Director of the United States Patent and Trademark Office*